US005421267A

United States Patent [19]

Mesko et al.

[11] Patent Number: 5,421,267

[45] Date of Patent: Jun. 6, 1995

[54] ARTICULATED PINCH DRIVE

[75] Inventors: Mark S. Mesko, Valenica; Ted W. Frederick, Saugus; Gregory L. Bahrman, Simi Valley; Aidan J. Bradley, Camarillo, all of Calif.

[73] Assignee: The Walt Disney Company, Burbank, Calif.

[21] Appl. No.: 281,747

[22] Filed: Jul. 28, 1994

[51] Int. Cl.[6] ..... B61B 13/00

[52] U.S. Cl. ..... 104/168

[58] Field of Search ..... 104/168, 165; 105/30, 105/32, 33, 82

[56] References Cited

U.S. PATENT DOCUMENTS

| | | | |
|---|---|---|---|
| 155,025 | 9/1874 | Holdam | 105/30 |
| 468,860 | 2/1892 | Wright | 105/30 |
| 3,056,359 | 10/1962 | Fey | 105/30 |
| 3,537,402 | 11/1970 | Harkess | 104/168 |
| 4,285,278 | 8/1981 | Mitchell | 104/168 |

FOREIGN PATENT DOCUMENTS

| | | | |
|---|---|---|---|
| 0875882 | 7/1971 | Canada | 105/30 |
| 0684399 | 11/1939 | Germany | 105/30 |
| 0252167 | 12/1987 | Germany | 104/168 |
| 1022079 | 3/1966 | United Kingdom | 105/30 |
| 1022080 | 3/1966 | United Kingdom | 105/30 |
| 1609729 | 11/1990 | U.S.S.R. | 104/168 |

*Primary Examiner*—Mark T. Le

*Attorney, Agent, or Firm*—Hecker & Harriman

[57] ABSTRACT

The present invention provides a drive system for a suspended or ground based roller coaster. Each vehicle has an attached drive fin. A plurality of pairs of drive wheels (pinch rollers) are disposed about the track and sequentially engage the drive fin to provide driving force. The drive wheels have a special linkage arrangement that permits the wheels to operate on curves or in a straight path. The linkage also provides self adjusting of the tension applied by the drive wheels to the drive fin to reduce wear and prevent slippage. The present invention uses pivots and tie bars to allow the system to articulate to accommodate the chording effects of the driven vehicle in a curve or helix. The self adjusting drive wheels operates during contact with the drive fin. The turning of the drive wheels in contact with the drive fin causes the drive wheels to generate a pinch force in a direction perpendicular to the vehicle drive fin. The applied force and drive wheel gap are self adjusting, providing more reliable operation, longer wear, and reducing or eliminating maintenance.

8 Claims, 6 Drawing Sheets

ARTICULATED PINCH DRIVE

BACKGROUND OF THE INVENTION

1. Field of the Invention

This invention relates to pinch roller drive mechanisms.

2. Background Art

Roller coaster rides require a means of propelling or driving the passenger cars to an elevated region of the ride, so that thereafter the cars can coast under the force of gravity. One well known prior art drive scheme uses a chain drive that pulls the passenger cars to the top of an incline. The chain is a linked loop that traces a path, for example, between two rails on which the passenger cars ride. The cars latch onto the chain and travel with the chain as it moves from the bottom of an incline to the top of the incline. At or about the apex of the incline, the cars are unlatched from the chain, the chain is looped below the track back to the bottom, and the cars begin a descent from the apex, powered by gravity.

A disadvantage of prior art chain drive systems is the requirement that the coaster must travel in a straight line. The chain forms a vertical loop, much as a chain on a bicycle, circles a drive gear and other tensioning rollers, usually at the top and bottom of the incline. It has heretofore not been practical to provide a chain drive that can be configured, for example, in an inclined spiral. It is desirable to provide a drive mechanism that permits a coaster to be driven upward in a spiral path, thus providing the ability of added entertainment for the coaster's passengers.

One chain drive scheme for propelling rail type amusement cars is described in Schwarzkopf, U.S. Pat. No. 4,361,094.

Another prior art drive system utilizes pinch wheel drives. In a pinch wheel drive system, the car to be driven includes a surface, often referred to as a "fin" mounted to the lower surface of the car. The fin is contacted on both of its sides by drive rollers. The rollers are rotating in opposite directions so as to propel the fin, and ultimately, the car, in one direction. The fin passes through a pinch roller "gap" between the pinch rollers. Typically the distance between the rollers to define the gap is fixed by positioning the rollers at a desired location and fixedly mounting them to a frame.

The rollers engage the fin with a large amount of force, so as to be able to impart driving force to the fin. This forced engagement, or "pinching" of the rollers must be consistent and approximately equal so that both wheels provide force to the fin. The pinching force is generally provided by a spring force that "squeezes" the pinch rollers together. Often the pinch rollers engage each other in the absence of a drive fin. Because the wheels are somewhat elastic or deformable, a gap can be created when a drive fin enters the pinch wheels.

A disadvantage of pinch drives of the prior art is the fact that motion of the coaster is restricted to a straight line. When the fin is at an angle to the wheels, it is difficult to provide adequate longitudinal force to both sides of the fin. The result is an inability to consistently drive the coaster. This problem is caused in part by the "chording" effect of a drive fin as it travels through a curve. The fin is physically displaced towards the inside of the curved path during travel. This creates a force against one of the pinch wheels. When the pinch wheels are fixedly mounted, as in the prior art, unwanted forces are generated on both the pinch wheels and the fin, resulting in possible failure. In other cases, the chording effect can cause displacement of the pinch wheel, pulling the drive fin away from the other pinch wheel and resulting in a lack of driving force and misregistration of the pinch wheels.

Another disadvantage of prior art pinch drives systems is the fact that a large spring force is required to provide the pinching force to the pinch wheels. This spring force causes the pinch wheels to wear against each other whenever they are not pinching against a drive fin. Over time, the frictional force acting on the wheels wears them down, causing the gap to widen, reducing performance and causing slipping of the fin. This creates a need for constant maintenance and adjustment of the position of the pinch wheels and of the urgent force applied to them.

A prior art pinch roller drive is described in German patent DD 252,267 A1. The system uses drive rollers mounted on a "U" shaped assembly that includes a scissoring mechanism. The scissors mechanism is activated so that the pinch wheels engage a rail beneath a car to be driven.

Brachand, French patent 2,595,310 describes a pinch wheel transport scheme that uses rotating wheels set in a guide track. The scheme uses a fixed gap between the rollers. The description includes an illustration of curved motion but does not illustrate self tensioning or self aligning drive wheels.

Nakagawa, Japanese patent 40-3-239661 describes a pinch roller driven dolly that includes a braking means that is automatically activated to prevent gaps between dollys that are pushed by the drive dolly.

Japanese patent 40-3-104,463 to Nakagawa describes a pinch drive system. Pinch rollers are brought into contact with upper and lower sides of a fin of a body to be driven. A scissors mechanism applies pinching force to the pinch wheels so that they contact the fin.

Soviet Union patent SU 1609-729-A describes a pinch drive system that includes tightening elements to press the drive wheels to the fin at a set force.

Schwarzkopf, U.S. Pat. No. 3,403,633 is directed to an amusement ride that uses pinch rollers to propel the car by engaging a drive plate member on the car. The roller pairs use resilient pneumatic tires that bear against the faces of a generally flat plate affixed to the car to be driven. The plates are described as being curved to conform to the radius of curvature of the track. The rollers are of a fixed gap type and susceptible to excessive wear.

U.S. Pat. No. 4,003,329 to Robinson is directed to a combination positioning and propelling apparatus for barges. Wheels are disposed on opposite sides of a barge to index and position the barge. In Robinson, the wheels are driven to impart a motive force to the barge. The wheels may be positioned at various widths to accommodate various size barges.

Schwarzkopf, U.S. Pat. No. 4,361,094 describes a drive system for roller coasters that utilizes a pair of chains having a series of links and segments. The system is to enable the use of pinch wheel drivers in both curved and straight sections of track. The drive member, or fin, of the '094 scheme is made limitedly laterally flexible so that it can conform to and align with the drive rollers in the curved and straight track sections.

U.S. Pat. No. 4,520,732 to Schwarzkopf is directed to a suspended roller coaster where the cars are suspended from an overhead rail. The '732 patent does not describe a drive mechanism for the coaster.

Sticht, U.S. Pat. No. 4,619,205 is directed to a conveyer arrangement for moving a carrier in a desired direction. A drive associated with one side of the carrier engages the one side and propelling the carrier in the drive direction. A conveyer roller presses guide rollers against the side of the carrier.

An apparatus for conveying a travelable body is described in Kiuchi, U.S. Pat. No. 5,067,413. Pivotally mounted drive rollers are brought into contact with a drive member and the drive rollers are rotated to propel the vehicle.

SUMMARY OF THE INVENTION

The present invention provides a drive system for a suspended or ground based roller coaster. Each vehicle has an attached drive fin. A plurality of pairs of drive wheels (pinch rollers) are disposed about the track and sequentially engage the drive fin to provide driving force. The drive wheels have a special linkage arrangement that permits them to operate on curves or in a straight path. The linkage also provides self adjusting of the tension applied by the drive wheels to the drive fin to reduce wheel wear and prevent slippage.

The present invention uses pivots and tie bars to allow the system to articulate to accommodate the chording effects of the driven vehicle in a curve or helix. The self adjusting drive wheels operate during contact with the drive fin. The turning of the drive wheels in contact with the drive fin causes the drive wheels to generate a pinch force in a direction perpendicular to the vehicle drive fin. The applied force and drive wheel gap are self adjusting, providing more reliable operation, longer wear, and reducing maintenance.

The present invention compensates for the chording effect of a drive fin traveling in a curved path through use of a self centering system. The self centering system consists of a linkage system that is spring biased so that the gap of the pinch wheels of the pinch drive system is positioned in the appropriate location to receive the drive fin. During travel of the drive fin through the pinch wheel gap, the drive fin is displaced first towards the inside of the curved path. The self centering linkage permits movement of the pinch wheels, and correspondingly, the pinch wheel gap to maintain registration with the drive fin. As the drive fin continues to travel and completes the turn, the drive fin is displaced back towards the outside of the curved path, towards or to its original position. The self centering linkage reacts and moves the pinch wheels to maintain registration until the drive fin has exited the pinch wheel gap. After the drive fin has exited, spring bias on the linkage holds the pinch wheels to the track centerline to receive the next coaster's drive fin.

The self centering linkage comprises a fixed cross member having pivot arms pivotally mounted at either end. A floating tie bar is coupled to the free ends of the pivot arms. The pinch wheels are coupled to the floating pivot joints where the tie bar is coupled to the pivot arms. Movement of the drive fin against one pinch wheel causes a force on the tie bar, displacing it in the direction of the force and causing the opposite pinch wheel to be displaced as well. After the drive fin has exited, a spring bias on the linkage returns it to track centerline, ready to receive the next coaster's drive fin.

The present invention includes equalizing linkage to provide self adjusting of the pinch wheels during operation. When a pinch wheel contacts the drive fin, a force is generated to push the drive fin through the pinch wheel gap. This force creates a reacting force that acts through an equalizing linkage to urge the other pinch wheel against the drive fin. As a result, the pinch wheels, in conjunction with the equalizing linkage, act to urge each other fighter against the drive fin. This automatically provides the proper pinch force on the pinch wheels during operation, eliminating the need to use a spring to provide the necessary pinch force.

The equalizing linkage includes a pair of link arms coupled to the end of the pivotally mounted support arms of the pinch wheels. The link arms are coupled to a pivotally mounted equalizer arm. The linkage is such that movement of one pinch wheel towards the other causes an equal movement of the other pinch wheel towards the first. The pinch wheels are urged toward each other by the force generated when the pinch wheel contacts the drive fin.

When the pinch wheel contacts the drive fin, a pivoting force is generated about the support arm of that pinch wheel. This pivoting force has two effects. First, it urges the pinch wheel toward the drive fin. Second, it creates a pivoting force that is transferred through the equalizing linkage to urge the other pinch wheel toward the drive fin. The pinch wheels then act in concert to urge each other against the drive fin.

DETAILED DESCRIPTION OF THE INVENTION

In the following description, numerous specific details are set forth in order to provide a more thorough understanding of the present invention. It will be apparent, however, to one skilled in the art, that the present invention may be practiced without these specific details. In other instances, well-known features have not been described in detail in order not to unnecessarily obscure the present invention.

The present invention provides pinch drive wheels that are self energizing, that is, the wheels automatically attain a desired gap and pressure on a drive fin. When no drive fin is present, the desired gap is zero. In addition, the present invention provides pinch drive wheels that automatically compensate for a drive fin in the chorded position as it travels through an arc or curve in the track. Each pinch wheel is provided with rotational motion through the combined actions of a motor, gearbox, drive pulley and drive belt associated with the pinch wheel. A pair of springs in combination with the self centering linkage is coupled to the left and right drive wheels to return the wheels automatically to a centered, properly gapped position. Pinch equalizer linkage acts in combination with a spring to maintain a constant initial force between the pinch wheels and the drive fin. This eliminates the need for continuous manual adjustment of the pressure of the drive wheels and reduces and compensates for wear. Where prior art systems can require up to 1800 pounds of continuous normal force, the scheme of the present invention may be accomplished with as little as 100 pounds of continuous normal force.

The present invention provides a controlled ratio between two distances. The first distance is the one between the self centering link floating pivot and the mid point of the centerline of the drive wheels. The second distance is that between the center of the tie bar and the centerline of the pinch wheels. The preferred embodiment of the present invention maintains this ratio at approximately 3.2: 1.

Figure 1:
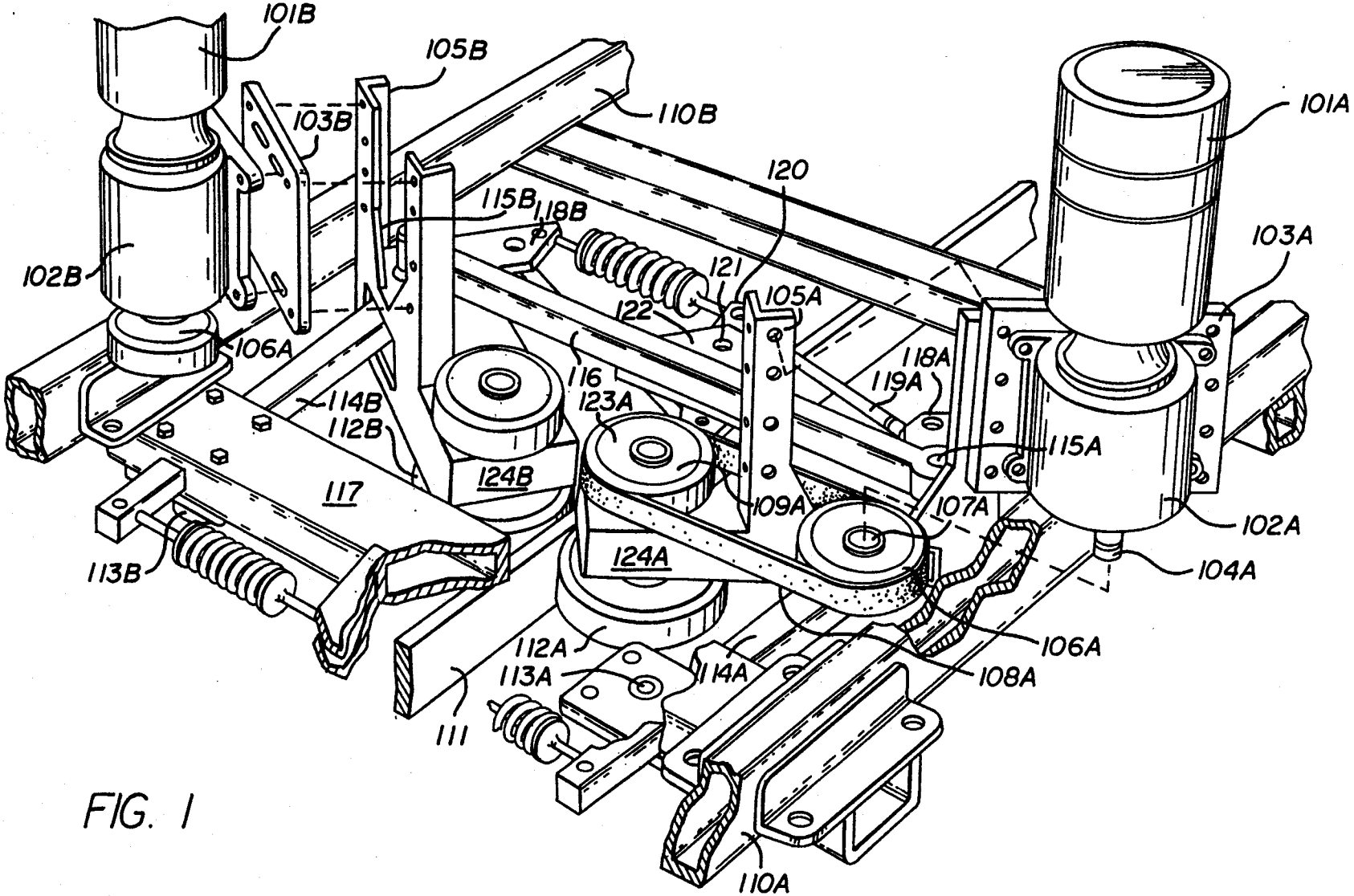
FIG. 1 is a perspective view of the present invention.
Figure 2:
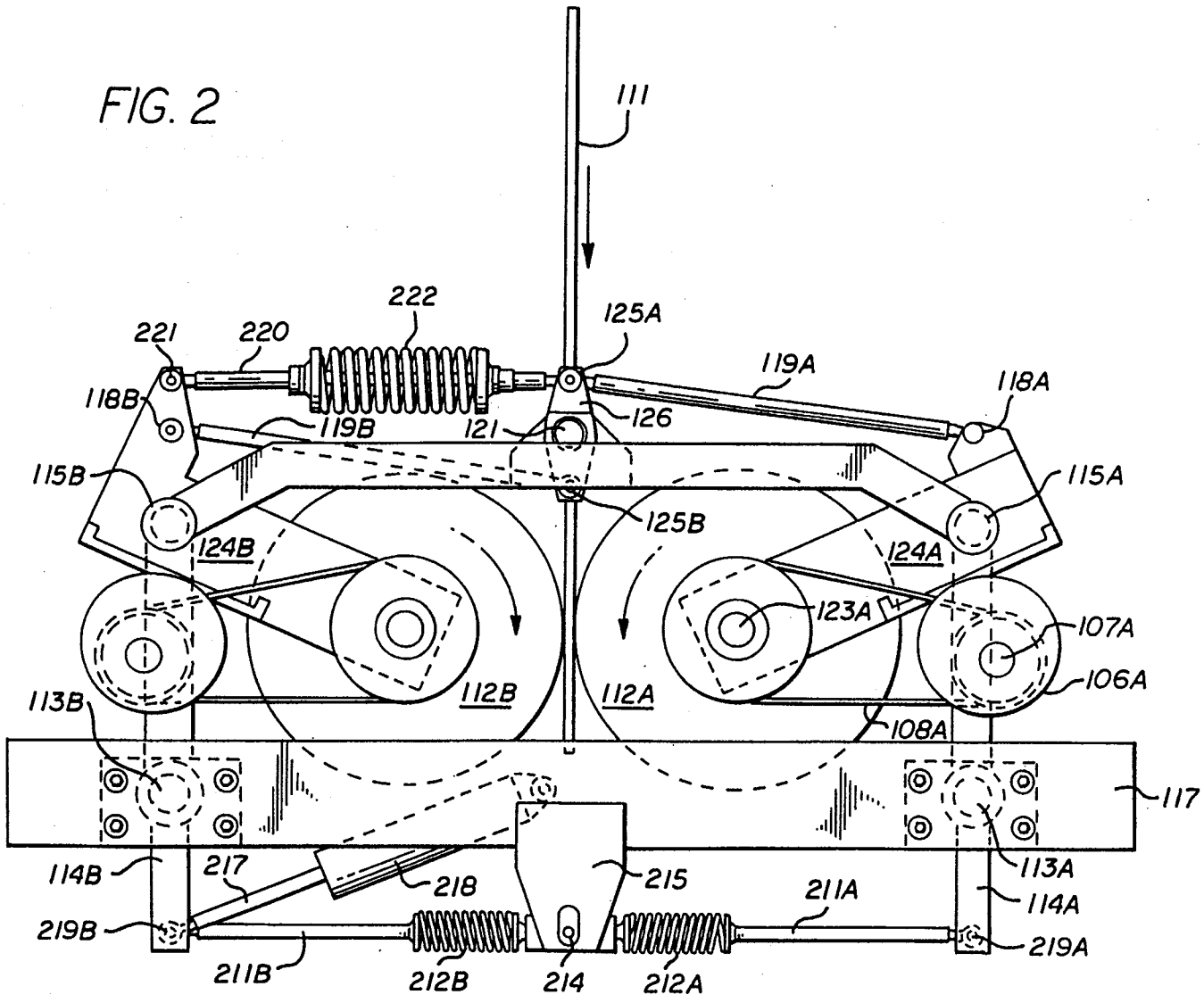
FIG. 2 is a plan view of the present invention.
Figure 3:
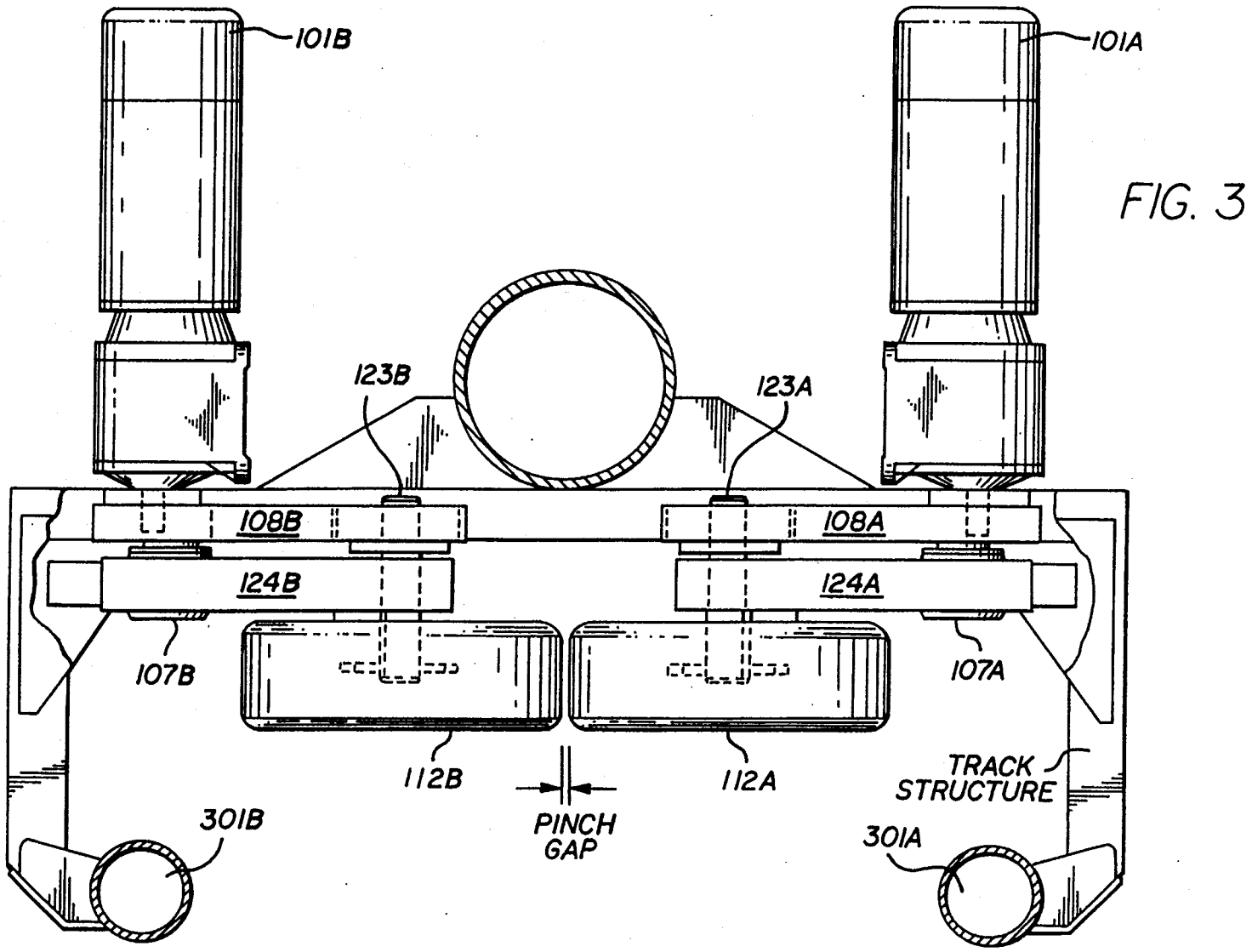
FIG. 3 is a front view of the present invention.

A perspective view of the present invention is illustrated in FIG. 1, a plan view in FIG. 2, and a front view in FIG. 3. The embodiment of FIGS. 1–3 is of a suspended roller coaster, where the drive fin 111 is mounted to the top of a chassis suspending the passenger car. The chassis (not shown) includes guide and load wheels that engage rails 301A and 301B. The drive fin is propelled by the present invention in a direction from the upper right of FIG. 1 to the lower left of FIG. 1 (Arrows in the figures indicate direction of travel or rotation). The present invention includes several assemblies, including a pinch drive wheel assembly, self centering linkage, and equalizer linkage.

Pinch Drive Wheel System

The drive wheel system is illustrated in FIGS. 1–3. The present invention utilizes two opposing drive wheels. The like elements of the two opposite rotating drive wheel systems are labeled A and B. This discussion refers to drive wheel system A and includes motor 101A, mounting plate 103A, gearbox 102A, motor shaft 104A, drive pulley 106A, shaft sleeve 107A, drive belt 108A, mounting bracket 105A, shaft 123A, and pinch wheel 112A.

The motor 101A is an electric motor in the present invention and operates through gearbox 102A to cause rotational movement of drive shaft 104A. The motor 101A, gearbox 102A and drive shaft 104A are mounted on mounting plate 103A. Mounting plate 103A is attached to mounting bracket 105A such that drive shaft 104A is received by, and linked to, shaft sleeve 107A of drive pulley 106A.

Drive pulley 106A is coupled to driven pulley 109A via drive belt 108A. Driven pulley 109A is coupled to pinch wheel 112A through shaft 123A. When activated, motor 101A turns shaft 104A which turns drive pulley 106A. Pulley 106A turn belt 108A, turning driven pulley 109A, which in turn causes pinch wheel 112A to turn counterclockwise.

The present invention may use other types of motors as desired. In addition, the drive shaft can be coupled to the pinch wheel through gearing means, as opposed to pulley and belt means. Alternatively, the motor 101A can be mounted directly on shaft 123A, driving the pinch wheel directly. Any method of imparting turning motion to the pinch wheel of the present invention may be used without departing from the scope and spirit of the present invention.

Self Centering Linkage

The self centering linkage is illustrated in FIGS. 1–3 and FIGS. 4A–4C. The self centering linkage of the present invention consists of a four bar linkage including cross member 117, tie bar 116, pivot arms 114A and 114B, self centering link pivots 115A and 115B, and 113A and 113B. Cross member 117 is a non moving member that is coupled between and to the frame rails. Pivot arm 114A is coupled to the cross member 117 at self centering link pivot 113A and to tie bar 116 at self centering link pivot 115A. Pivot arm 114B is coupled to the cross member 117 at self centering link pivot 113B and to tie bar 116 at self centering link pivot 115B. Pivot arms 114A and 114B are approximately the same length and move in parallel to one another. Tie bar 116 moves left and right in parallel to fixed cross member 117.

Self centering link pivots 115A and 115B are coupled to arms 124A and 24B. As a result, movement of the self centering linkage results in movement of the arms 124A and 124B and ultimately, of pinch wheels 112A and 112B.

Figure 4A:
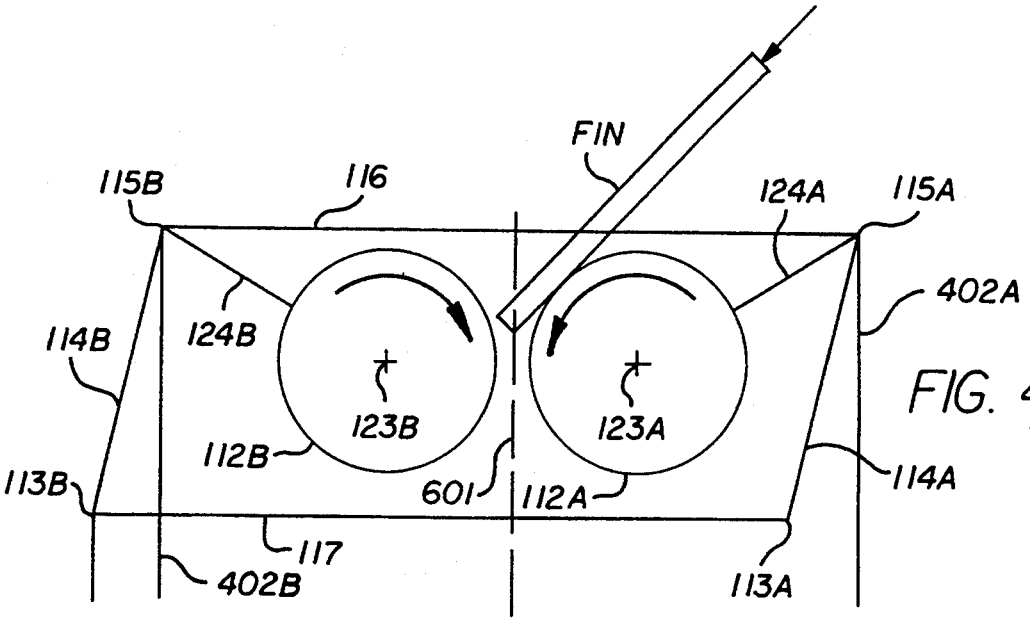
FIGS. 4A–4C illustrate the operation of the mechanism in the present invention.
Figure 4B:
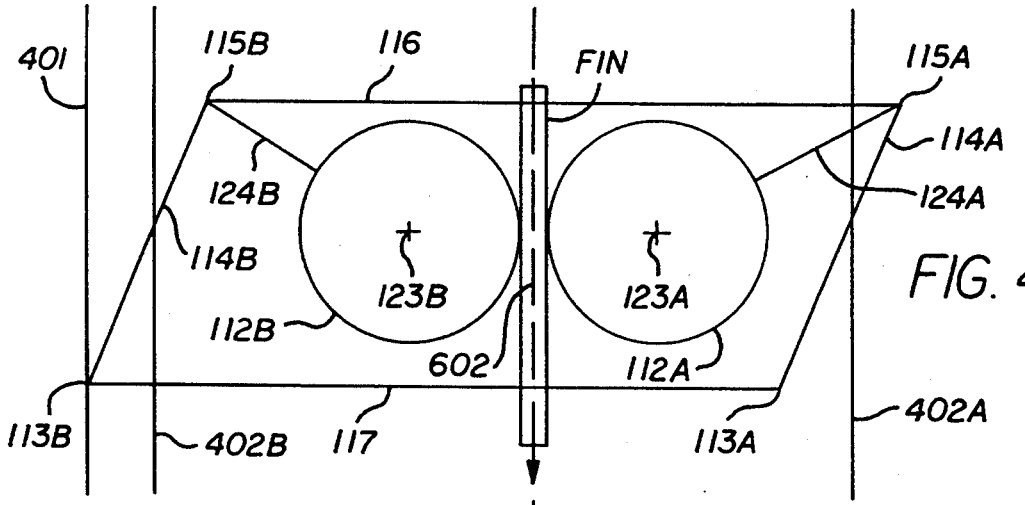
Figure 4C:
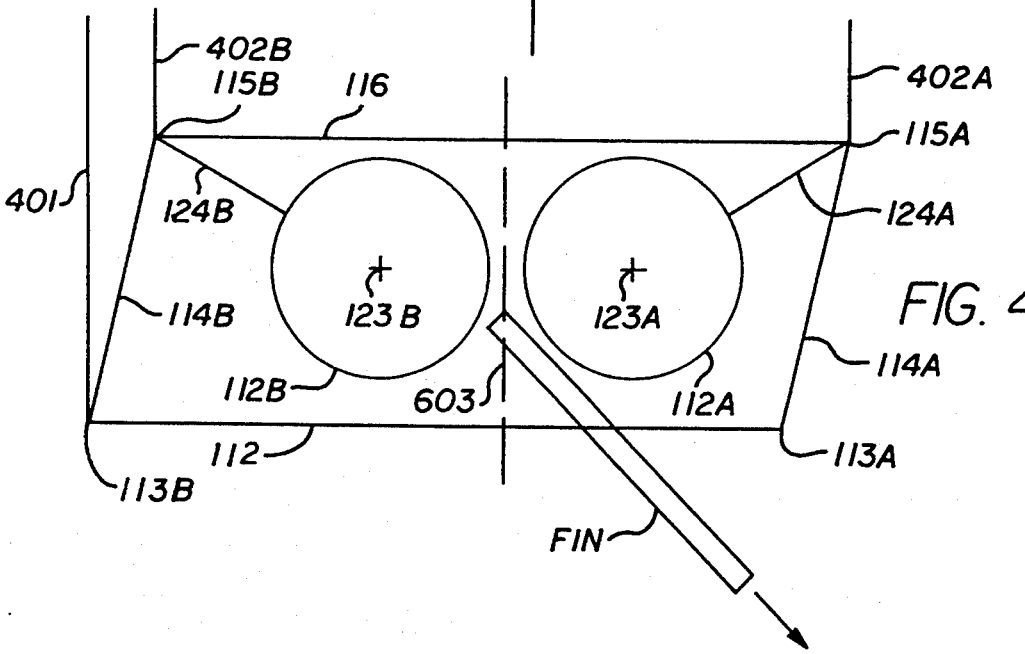
Figure 6A:
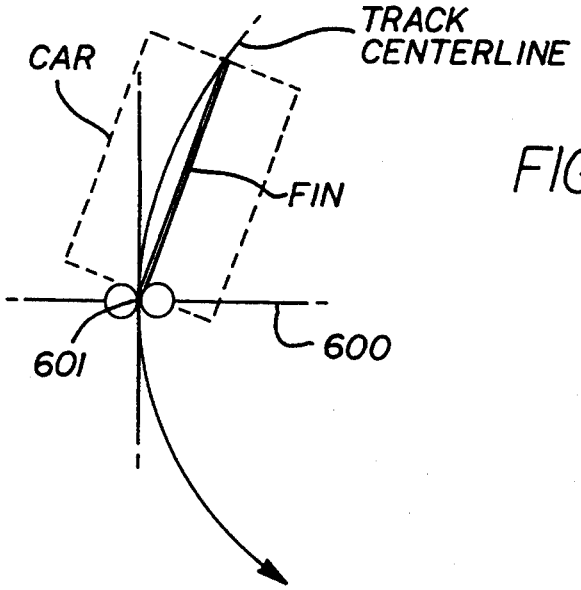
FIGS. 6A–6C illustrate the chording effect of a drive fin during a turn.

The problem caused by chording of the drive fin as a ride vehicle goes through a turn is illustrated in FIGS. 4A–4C. The car is heading from the top of the page to the bottom of the page and making a turn in a counterclockwise direction. Referring first to FIG. 6A, the car is shown with a drive fin mounted longitudinally. The line 600 represents the line between the center points of two drive wheels. The fin crosses line 600 at point 601. The fin must pass between the pinch wheels, so the gap between the pinch wheels must be centered with respect to the track at point 601 when the car enters the turn.

Figure 6B:
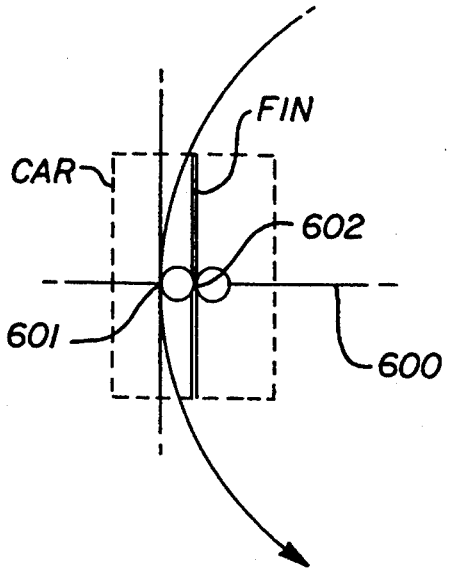

In FIG. 6B, the car is halfway through the turn and, in turning, is positioned such that the fin intersects line 600 at point 602. Point 602 is displaced from point 601 toward the inside of the turn. This displacement is the chording effect of a straight fin traveling through a turn. When the car is in the position illustrated in FIG. 6B, the gap between the pinch wheels must be at point 602. Thus, there must be a mechanism to allow the pinch wheels to travel with the fin to compensate for the chording effect.

Figure 6C:
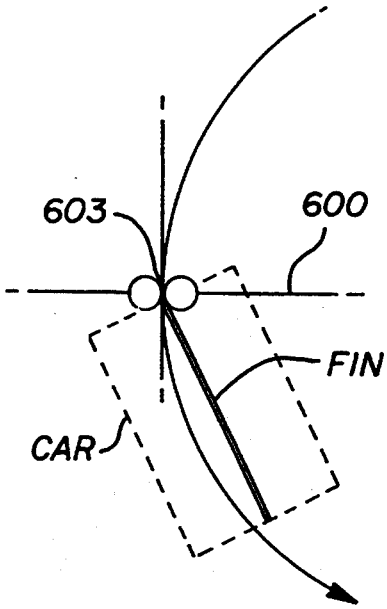

In FIG. 6C, the car leaves the turn. The end of the fin intersects line 600 at point 603. The point of intersection of the fin entering the turn is approximately the same as the point of intersection of the fin leaving the turn. Thus, the pinch wheels must be able to return to the starting position after the car has passed by. Ideally, the fin returns the pinch wheels to the starting position as it exits the mechanism. The self centering mechanism of the present invention provides the ability to hold the pinch wheels in this position to receive the next fin.

The operation of the self centering linkage is illustrated in FIGS. 4A–4C. Referring first to FIG. 4A, the self centering mechanism describes a parallelogram consisting of fixed cross member 117, pivot arms 114A and 114B, and tie bar 116. The pinch wheels 112A and 112B are coupled through arms 124A and 124B to floating pivot joints 115A and 115B respectively. Pivot arms 114A and 114B are also linked to floating pivot joints 115A and 115B, respectively, and to cross member 117 at fixed pivot joints 113A and 113B, respectively.

The self centering mechanism is spring biased so that under no load, the gap between the pinch wheels 112A and 112B is at point 601, ready to receive the fin of the next car, as shown in FIG. 4A.

The spring biasing means is illustrated in FIG. 2. A pair of spring arms 211A and 211B are coupled at pivot points 219A and 219B to pivot arms 114A and 114B respectively. Spring arms 211A and 211B are also coupled to plate 215 at point 214. Each arm includes a spring member 212A and 212B, respectively, that urges the assembly to a centered position. The plate 215 is mounted to cross member 117.

As the car travels through its turn, the fin is displaced to the right. As the displacing force acts on pinch wheel 112A, force is transmitted through arm 124A to floating pivot joint 115A. Joint 115A is displaced to the right (and slightly down) causing pivot arm 114A to pivot about fixed joint 113A in a clockwise direction. This movement causes tie bar 116 to move to the right and down, and causes pivot arm 114B to pivot about fixed joint 113B in a clockwise direction. The result is displacement of the gap between pinch wheels 112A and 112B to the right, to coincide with the new position of the fin. This is illustrated in FIG. 4B, which shows the gap at position 602.

The cross member 117 and fixed pivot joints 113A and 113B remain stationary, as illustrated by line 401. Floating pivot joints 115A and 115B and, correspondingly, pivot arms 114A and 114B, are displaced to the right. This is shown by their displacement from lines 402A and 402B in FIG. 4B.

As the car exits the drive wheels, the drive wheels are displaced to the left, to approximately their original position. The force of the fin acting on pinch wheel 112B, and the urgent force of the biasing springs, cause the entire mechanism to return to its original position, as shown in FIG. 4C. The self centering mechanism is not shown in FIGS. 4A–C. The gap between pinch wheels 112A and 112B is now at point 603, substantially coincident with starting point 601.

As the fin leaves the gap, it is not necessary that the gap be at the same location as when the fin enters the gap. The biasing force centers the gap after the fin has exited so that the assembly is in the proper position to receive the next fin.

Although the present invention may be implemented with any dimensions, the preferred embodiment contemplates maintaining a certain ratio between some of the dimensions of the linkages and pivots. Let M be the midpoint of the centerline of the pinch wheels (i.e. the center point of a line drawn between points 123A and 123B of pinch wheels 112A and 112B). Let F be the location of floating pivot joint 115A or 115B. Let m be the center point of tie bar 116. In the preferred embodiment the ratio of the length of line FM to the length of line mM is approximately 3.2:1. This is desired to provide the proper normal force and to provide a dynamically stable system.

Equalizer Linkage

Figure 5A:
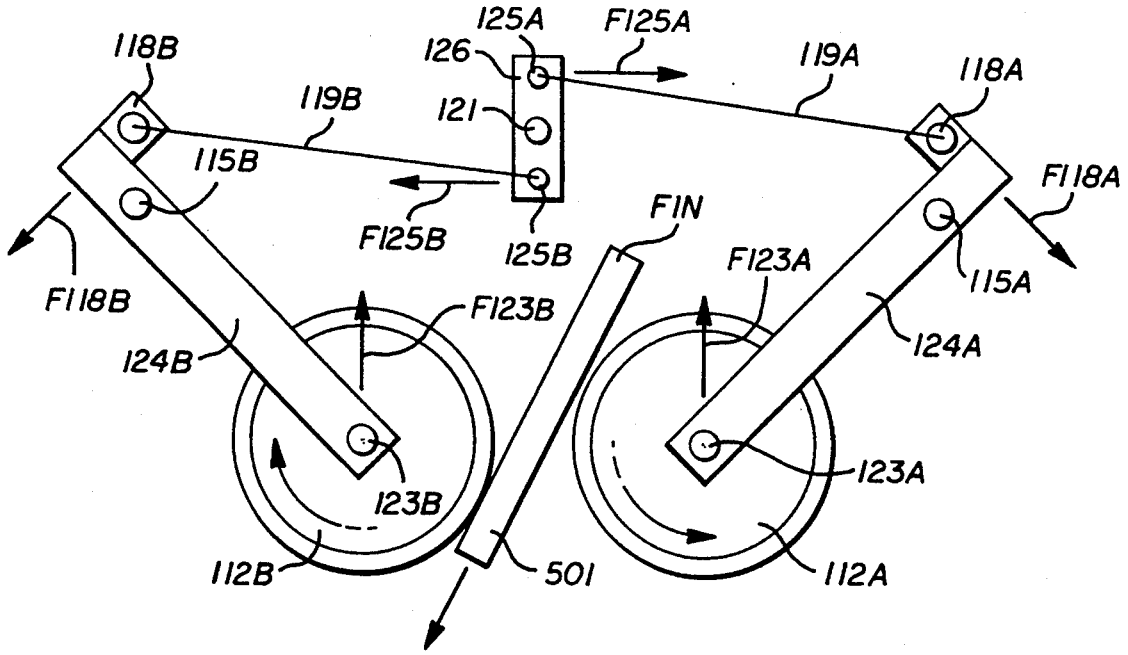
FIGS. 5A–5B illustrate the operation of the equalizer linkage of the present invention.
Figure 5B:
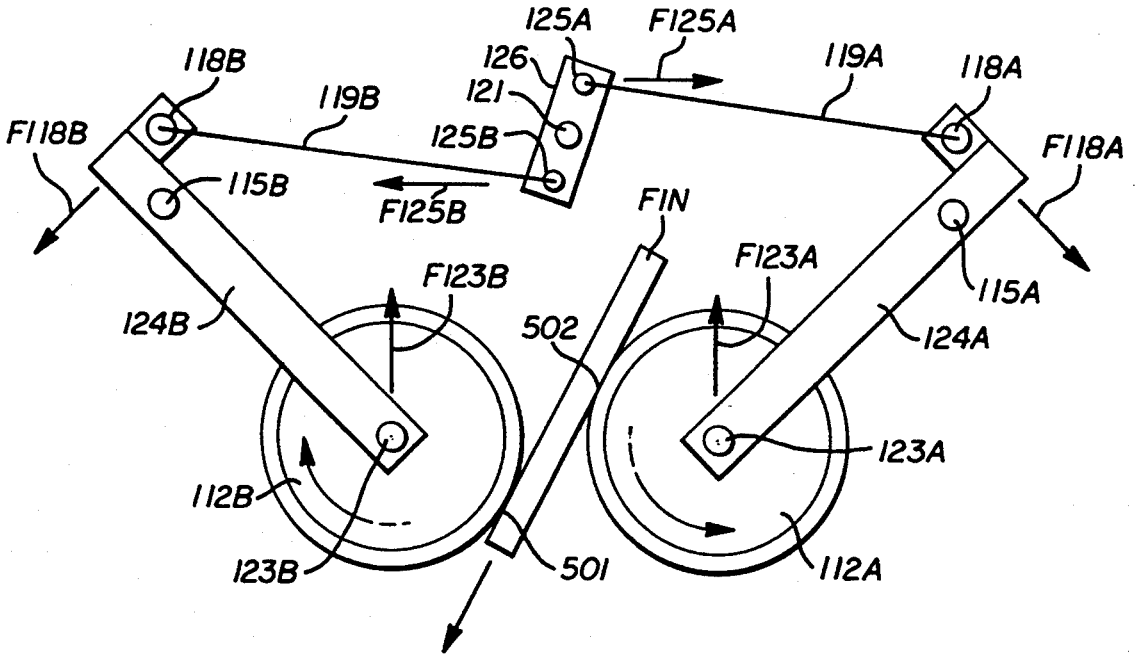

Referring again to FIGS. 1–3 and to FIGS. 5A–5B, the equalizer linkage of the present invention consists of link arms 119A and 119B, mounting plate 122, link pivot joints 125A and 125B, pivot joints 118A and 118B, pivot joints 115A and 115B, center pivot 121, arms 124A and 124B, and pinch wheels 112A and 112B.

The operation of the equalizer linkage is illustrated in FIGS. 5A and 5B. Referring first to FIGS. 1–3 and FIG. 5A, pinch wheels 112A and 112B are coupled to pinch wheel arms 124A and 124B at points 123A and 123B, respectively. Arms 124A and 124B are pivotally mounted to the assembly; of the present invention at pivot points 115A and 115B, respectively.

Arm 124A is coupled to link arm 119A at pivot joint 118A. Link arm 119A is in turn coupled to equalizer arm 126 at pivot joint 125A. Arm 124B is coupled to link arm 119B at pivot joint 118B. Link arm 119B is in turn coupled to equalizer arm 126 at pivot joint 125B. Equalizer arm 126 pivots about pivot joint 121.

The pinch wheels 112A and 112B are shown with an exaggerated gap between them in FIG. 5A to illustrate the operation of the present invention. Consider the situation where a drive fin enters the pinch wheel gap at an angle, as on a turn, and contacts one of the pinch wheels first. In the example shown, the drive fin first contacts pinch wheel 112B at point 501. The pinch wheels turn opposite each other to cause the drive fin to move in a direction from the top of the page to the bottom of the page. Thus, pinch wheel 112B is rotating in a clockwise direction and pinch wheel 112A is rotating in a counterclockwise direction.

As pinch wheel 112A engages the drive fin, the rotation of the pinch wheel causes it to "grab" the drive fin due to the small initial pinch force supplied by spring 222, resulting in a force being exerted on the drive wheel in substantially the opposite direction of travel of the drive fin. This force is illustrated in FIG. 5A as force F123B, shown acting at point 123B. This upward force F123B causes a counterclockwise pivoting of arm 124B about pivot point 115B, resulting in a downward force F118B acting on the arm at pivot joint 118B.

Force F118B pulls link arm 119B to the left, creating a pivoting force F125B to act on equalizer arm 126 at pivot joint 125B. This results in a clockwise pivoting force F125A acting on equalizer arm 126 at pivot joint 125A. Force F125A pushes link arm 119A to the right, creating a clockwise force F118A to act on arm 124A at pivot joint 118A. Force F118A causes a corresponding clockwise force F123A to act on arm 124A at point 123A. The clockwise pivoting of arm 124A in turn causes pinch wheel 112A to move toward the drive fin until it contacts it.

The contact of pinch wheel 112A with the drive fin as a result of the equalizer linkage is illustrated in FIG. 5B. Both pinch wheels are now generating a force in substantially opposite the direction of travel of the drive fin. These forces cause the pinch wheels to be urged together, due to the action of the equalizing linkage. Notice the clockwise displacement of the equalizer arm 126 in FIG. 5B. Pinch wheel 112A now contacts the drive fin at point 502. The action of the equalizing linkage causes the pinch wheels themselves to be urged against the drive fin with sufficient force to maintain adequate contact, reducing or preventing slippage.

In the preferred embodiment of the present invention, the pinch wheels are spring biased so that they are touching when there is no fin present. However, the constant urgent force of the spring is relatively low compared to prior art schemes. It has been found that the present invention can operate with spring forces on the order of 100 lbs. The pinch force is serf generated during operation, due to the equalizing linkage, avoiding the need for higher spring pressures. This low spring pressure significantly reduces wear during operation of the drive system. In addition, because the system is self energizing, the need to maintain and adjust the pinch force is reduced or eliminated.

The spring biasing of the pinch wheels is illustrated in FIG. 2. Arm 220 is coupled to arm 124B at pivot point 221 and to equalizer arm 126 at pivot point 125A. Arm 220 includes an adjustable spring 222 that urges the pinch wheels 112A and 112B together when there is no fin between the pinch wheels.

Thus, an articulated pinch roller drive has been described.

We claim:

1. A pinch drive system comprising:

a first pinch wheel rotating in a first direction, said first pinch wheel coupled to a first pivotally mounted pinch wheel arm;

a second pinch wheel rotating in a second direction, said second pinch wheel coupled to a second pivotally mounted pinch wheel arm;

a cross bar member fixedly coupled to first and second fixed pivot joints;

a first pivot arm having first and second ends, said first pivot arm coupled to said cross bar member at said first end at said first fixed pivot joint;

a second pivot arm having first and second ends, said second pivot arm coupled to said cross bar member at said first end at said second fixed pivot joint;

a tie bar having first and second ends, said tie bar coupled at a first floating pivot joint to said second end of said first pivot arm, said tie bar coupled at a second floating pivot joint to said second end of said second pivot arm;

spring means coupled to said pivot arm to urge said tie bar to a desired position.

2. The system of claim 1 wherein said cross bar member, said first and second pivot arms, and said tie bar define a parallelogram.

3. The system of claim 1 wherein a force acting in a first direction on said first pinch wheel causes displacement of said tie bar and said first and second pinch wheels in said first direction.

4. The system of claim 3 wherein a force acting in a second direction opposite said first direction on said second pinch wheel causes displacement of said tie bar and said first and second pinch wheels in said second direction.

5. The system of claim 1 wherein the ratio of the distance between said second end of said first pivot arm and a midpoint between the center of said first pinch wheel and said second pinch wheel and the distance between a center of said tie bar and said midpoint is approximately 3.2:1.

6. A pinch drive system comprising:

a first pinch wheel rotating in a first direction, said first pinch wheel coupled to a first pinch wheel arm pivotally mounted to a first pivot joint;

a second pinch wheel rotating in a second direction, said second pinch wheel coupled to a second pinch wheel arm pivotally mounted to a second pivot joint;

a first link arm having first and second ends coupled at said first end to said first pinch wheel arm, said first link arm coupled at said second end to a first end of an equalizer arm;

a second link arm having first and second ends coupled at said first end to said second pinch wheel arm, said second link arm coupled at said second end to a second end of said equalizer arm;

said equalizer arm pivotally mounted to a third pivot joint;

spring means coupled to said system to urge said first and second pinch wheels toward each other.

7. The system of claim 6 wherein said first pinch wheel generates a pivoting force when said first pinch wheel contacts an object between said first and second pinch wheels, said pivoting force acting through said first and second link arms and said equalizing arm to urge said second pinch wheel toward said first pinch wheel.

8. The system of claim 6 wherein said second pinch wheel generates a pivoting force when said second pinch wheel contacts an object between said first and second pinch wheels, said pivoting force acting through said first and second link arms and said equalizing arm to urge said first pinch wheel toward said second pinch wheel.

* * * * *